United States Patent [19]

Solomon

[11] Patent Number: 4,565,078

[45] Date of Patent: Jan. 21, 1986

[54] LOCK ASSEMBLY

[76] Inventor: Martin D. Solomon, 26 Margret Ave., Lawrence, N.Y. 11559

[21] Appl. No.: 472,037

[22] Filed: Mar. 4, 1983

[51] Int. Cl.[4] ..... E05B 65/08

[52] U.S. Cl. ..... 70/95; 70/100; 70/DIG. 20; 70/DIG. 27; 292/150; 292/179

[58] Field of Search ..... 70/95, 99, 100, 79, 70/85, 89, 90, 423, DIG. 20, DIG. 27; 292/150, 153, 345, 179, 302

[56] References Cited

U.S. PATENT DOCUMENTS

| | | | |
|---|---|---|---|
| 1,076,835 | 10/1913 | Lyons . | |
| 1,409,429 | 3/1922 | Tanski . | |
| 1,938,339 | 12/1933 | Keil | 70/100 |
| 2,038,827 | 4/1936 | Carvette | 292/179 |
| 2,749,165 | 6/1956 | Coulter | 292/302 X |
| 3,002,365 | 10/1961 | Liljequist | 292/302 X |
| 3,082,617 | 3/1963 | Kerman | 70/100 X |
| 3,343,386 | 9/1967 | Hall | 70/423 |
| 3,444,712 | 5/1969 | Greenwald | 70/423 |
| 3,536,349 | 10/1970 | Gardner et al. | 292/179 X |
| 3,600,912 | 8/1971 | Foreman | 70/77 |
| 3,744,283 | 7/1973 | Schmidt . | |
| 3,768,847 | 10/1973 | Buck, Jr. et al. | 292/179 |
| 3,811,302 | 5/1974 | Sorensen . | |
| 3,877,261 | 4/1975 | Robins . | |
| 4,073,517 | 2/1978 | Bills . | |
| 4,345,448 | 8/1982 | Solomon | 70/95 |

*Primary Examiner*—Kenneth J. Dorner
*Assistant Examiner*—Lloyd A. Gall
*Attorney, Agent, or Firm*—Roylance, Abrams, Berdo & Goodman

[57] ABSTRACT

A locking assembly for a gate locking system comprises a gate movable within opposed channeled guide tracks with one track and gate having aligned apertures. The lock assembly is mounted on the track over the aligned apertures and has a locking bolt slidably mounted within its housing for axial movement between a locking position extending through the track and gate apertures, and an unlocked position removed from the gate and track apertures. The bolt has a radially projecting shoulder on its outer surface between its inner and outer ends. A spring biases the bolt towards its unlocked position. A lug is movably mounted in the housing between a first position engaging the bolt and retaining the bolt in its locking position, and a second position disengaged from the bolt for releasing the bolt for axial movement within the housing.

25 Claims, 6 Drawing Figures

LOCK ASSEMBLY

BACKGROUND OF THE INVENTION

1. Field of the Invention

This invention relates to a lock assembly for a roll-up door and to a gate locking system providing a high degree of protection from unauthorized entry, while being simple and quick to operate. More particularly, the present invention relates to a system for locking a gate movable between opposed tracks in a closed position providing a high degree of protection against burglary and being substantially self-contained such that its only removable part is its key.

2. Description of the Prior Art

Gate locking systems employed are security gates for factory doors, mall grills, store fronts, trucks and the like conventionally comprise opposed channel guide tracks and a gate movable within the tracks between open and closed positions. In high crime areas, the system must be capable of preventing unauthorized opening by both covert attacks (i.e., attempting to unlock the system without damaging it) and overt attacks (i.e., attempting to open the system by physically destroying it). Conventional gate locking systems are not able to provide adequate security against both covert and overt attacks, and are relatively expensive and difficult to manufacture and operate.

One conventional system is disclosed in U.S. Pat. No. 3,600,912 to Foreman. The Foreman arrangement comprises a sleeve which is fitted within aligned holes within the track and gate when the gate is closed, and a key cylinder with a threaded bolt which can only be turned to lock the sleeve in place when its key is in its key hole. A bracket is provided on the track for storing the parts when not in use. Thus, the Foreman system has a number of parts separable from the gate and track which have a tendency to become lost, and is difficult and time consuming to assemble and securely lock during the closing operation.

Another locking mechanism for this environment is disclosed in applicant's own U.S. Pat. No. 4,345,448, which patent is incorporated herein by reference. The system disclosed in such patent comprises a separable bracket and lock which must be mounted on a track and gate assembly to lock the gate. Thus, this system also requires parts which are separable from the track and gate and susceptible to being lost, and require considerable time to lock the assembly in aligning the bracket, mounting the lock and actuating the lock by the key.

The ability of the locking system to be self-contained and attached to the track, except for the key, prevents loss of portions of the locking assembly. The time required to assemble and actuate the lock is extremely critical since the store owner's or truck operator's exposure and susceptibility to robbery and burglary are at their highest level during the closing operation. Thus, it is extremely important that the locking mechanism operate to lock the gate in its closed position without searching for and aligning the various lock system parts and without using a key.

SUMMARY OF THE INVENTION

Accordingly, an object of the present invention is to provide a locking assembly and gate locking system having all the necessary parts thereof, except the key, formed as a single unit attached to a track for the gate.

Another object of the present invention is to provide a locking assembly and gate locking system which is simple and inexpensive to manufacture, install and operate.

A further object of the present invention is to provide a locking assembly and gate locking system which can be quickly secured in its locked position without the use of a key.

A still further object of the present invention is to provide a locking assembly and gate locking system which provides a high degree of protection against overt and covert attacks.

Other objects, advantages and salient features of the present invention will become apparent from the following detailed description of preferred embodiments of the invention.

Briefly described, the invention includes a lock assembly for a roll-up door which slides in two, oppositely directed tracks. The lock assembly comprises a housing which can be secured to one of the tracks, a locking bolt mounted in the housing, a spring for biasing the bolt and a lug movably mounted in the housing. The locking bolt slides axially within the housing between locking and unlocked positions, and has a radially projecting shoulder on its outer surface between its inner and outer ends. A caming surface extends from the shoulder and tapers toward the inner end. The spring engages the housing and the bolt in order to bias the bolt towards its unlocked position. The lug means moves in the housing between a first position engaging the bolt shoulder to retain the bolt in its locking position, and a second position disengaged from the bolt shoulder to release the bolt for axial movement in the housing.

By forming the lock assembly in this manner, the camming surfaces will force the lug to its second position as the bolt is moved axially towards its locking position. Since the camming surface moves the lug to the second position, a key is not necessary to accomplish such movement. Since the mechanism can be locked by a simple sliding action of the locking bolt, the mechanism can be secured in an extremely short period of time, therby minimizing a store owner's or truck operator's exposure during the closing operation.

The invention also includes a gate locking system comprising opposed channel tracks, a gate movable within the tracks and a lock assembly. At least one of the tracks has a hole extending through it. The gate has at least one aperture through it aligned with the track when in its closed position. The lock assembly is mounted on one of the tracks over the hole and includes a housing, a locking bolt, a spring and a lug. The housing is fixedly coupled to the track. The locking bolt is slidably mounted in the housing for axial movement between a locking position extending through the track hole and an unlocked position removed from the track hole. The bolt also has a radially projecting shoulder on its outer surface between the inner and outer ends. The spring engages the housing and the bolt biasing the bolt towards its unlocked position. The lug is movably mounted in the housing between a first position engaging the bolt shoulder to retain the bolt in its locking position, and a second position disengaged from the bolt shoulder releasing the bolt for axial movement in the housing.

By forming the gate locking system in this manner, no parts need be removed from the track, except for the key. Thus, the chance of losing a necessary part of the system is obviated. Moreover, the system is simple and inexpensive to manufacture and operate, and can be be actuated extremely rapidly.

Movement of the lug can be controlled by a spring and by a key operated cylinder. The spring biases the lug toward engagement with the bolt, while the key operated cylinder moves the lug against the bias of the spring to disengage the lug from the bolt. The key actuated cylinder can be mounted in the housing adjacent a key receiving opening that is smaller than the cylinder to prevent removal of the key cylinder.

The bolt can comprise a head which is releasably coupled to a body member by a shear pin. If the bolt is pulled attempting to remove it without releasing the lug, the head will separate from the body member to defeat the attempted unauthorized entry. Additionally, the exposed end of the body member can be tapered towards the outer end such that it cannot be gripped effectively.

The bolt can have an annular flange releasably secured to and extending perpendicularly from its inner end. This flange will engage the track adjacent its hole preventing removal of the bolt from the track hole by bending the track with a bar. The releasable coupling of the flange to the bolt permits the bolt and spring to be removed for replacement or maintenance.

BRIEF DESCRIPTION OF THE DRAWINGS

Referring to the drawings which form a part of this original disclosure.

DETAILED DESCRIPTION OF THE PREFERRED EMBODIMENTS OF THE INVENTION

Figure 1:
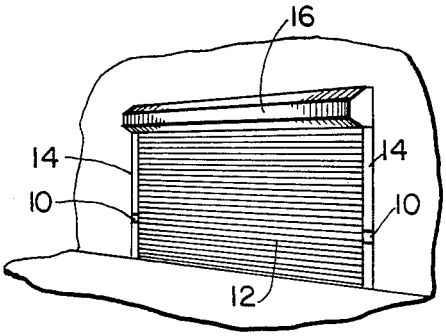
FIG. 1 is a perspective view of a locking gate system according to the present invention.

Referring initially to FIG. 1, the lock assembly 10 of the present invention is primarily intended for use in a gate locking system comprising a roll-up gate 12 and opposed channel guide tracks 14. Gate 12 comprises a plurality of horizontally extending and hingedly interconnected louvres having concave-convex shapes. The opposite sides of the gate are received in guide tracks 14 permitting the gate to move between open and closed positions. In the open position, the gate is received in a fixed, hollow heading 16. A lock assembly 10 may be provided on one or both of guide tracks 14, as desired. The location of the lock assembly along the height of the guide track is chosen so as to facilitate its operation.

The details of the lock assembly are illustrated in FIGS. 2–5. Basically, the lock assembly comprises a housing assembly 18, a locking bolt 20 slidably mounted in the housing between a locking position (illustrated in FIGS. 2–4) and an unlocked position (illustrated in FIG. 5), and a lug mechanism 22 for releasably retaining the locking bolt in its locking position.

Housing assembly 18 comprises an outer housing 24 and an inner housing 26 which is surrounded by the outer housing. Outer housing 24 has outwardly projecting flanges 28 which are fixedly secured to an outer surface of track 14 by welding. A circular opening 30 is formed in the front face 32 of the outer housing permitting locking bolt 20 to pass therethrough. Access openings 34, provided at the upper and lower portions of opening 30, elongate opening 30 facilitating manually gripping of the bolt by fingers, while preventing engagement of the bolt by a gripping tool.

Inner housing 26 has a horizontal through passageway 36 slidably receiving locking bolt 20. Adjacent the inner end of the housing, passageway 36 has a recess 38 and a radially inwardly projecting annular shoulder 40. The diameter of opening 30 is greater than the cross-sectional diameter of passageway 36 such that a shoulder 42 is formed at the juncture of the opening and passageway. Extending vertically from horizontal passageway 36 is a vertical passageway 44 in which lug mechanism 22 is received. Passageway 44 has a relatively narrow upper section 46, a relatively wider lower section 48 and a radially inwardly extending annular shoulder at the junction of the upper and lower sections.

Locking bolt 20 is generally cylindrical with a radially outwardly extending annular shoulder 52 intermediate its inner end 56 and outer end 54. On its inner end side, shoulder 52 has a frustoconical camming surface 58 tapering toward inner end 56 and terminating in an annular radially extending shoulder 60. At the opposite end of shoulder 52, a radially inwardly extending recess 62 is formed. Shoulder 52 defines one side of recess 62. Locking bolt 20 has a tranverse cross-sectional width or diameter in recess 62 substantially equal to the tranverse cross-sectional width or diameter of the locking bolt between camming surface 58 and inner end 56.

A releasable head 64 is mounted on bolt outer end 54. The head is releasably secured to the bolt by a shear pin 66 extending through axially aligned openings in outer end 54 and head 64. The outer end is received within a cavity in the head. Head 64 engages shoulder 52 preventing over insertion of the bolt.

Figure 5:
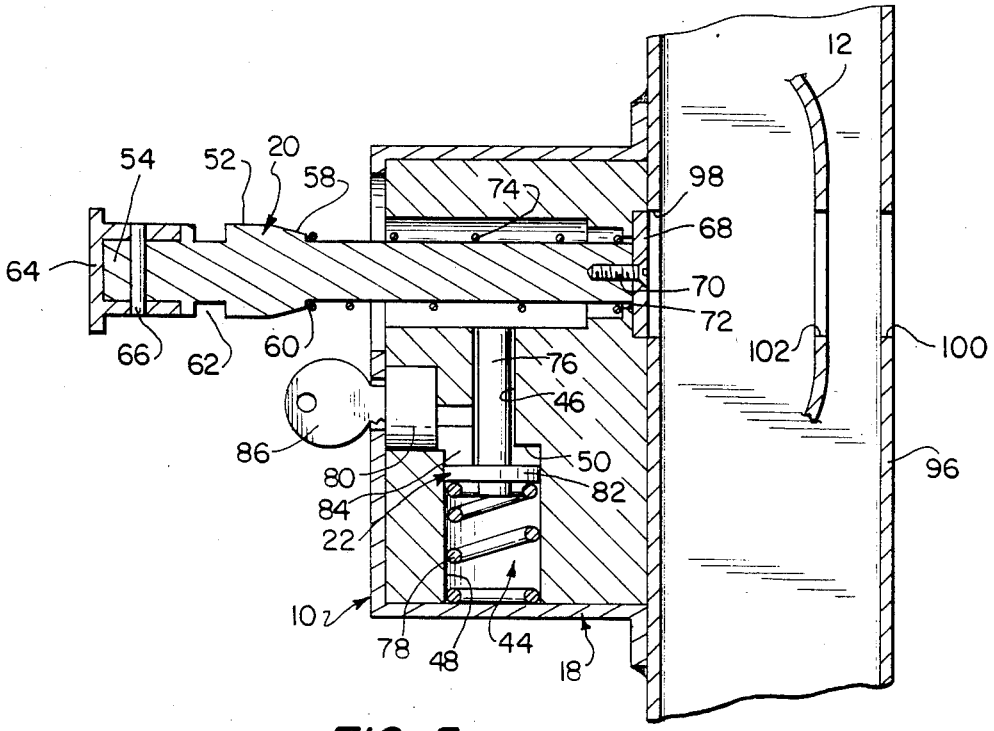
FIG. 5 is a side elevational view of the gate locking system of FIG. 4 in the unlocked position.

Inner end 56 has an annular, perpendicularly extending flange 68. The flange comprises a washer releasably coupled to the inner end of the locking bolt by a threaded faster 70. Flange 68 extends in a radial direction relative to the locking bolt for a distance greater than the radius of opening 72 through annular shoulder 40, such that engagement of shoulder 40 and flange 68 limits the amount bolt 20 can be retracted from housing 18, as illustrated in FIG. 5. The releasable mounting of flange 68 by screw 70 permits the flange to be removed from the locking bolt in situ, thereby permitting removal of the bolt from the housing without removing the housing from the guide track.

A spring 74 is mounted about locking bolt 20 and abuts locking bolt shoulder 60 and housing shoulder 40 biasing the bolt to its unlocked position. The spring can be easily replaced within the housing, without removal of the housing from the track, by removal of the bolt as discussed above.

Figure 4:
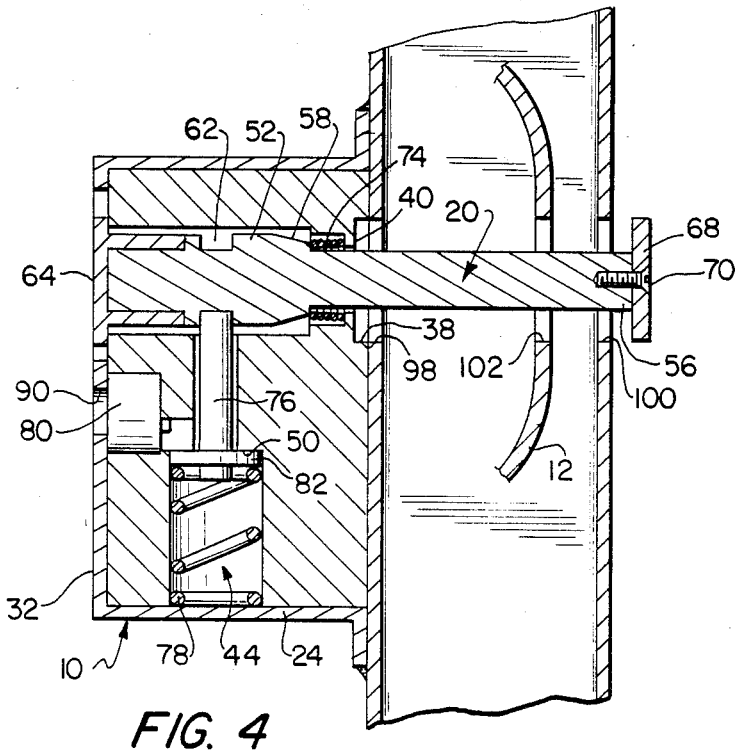
FIG. 4 is a side elevational view in section of the gate locking system of FIG. 1 taken along lines 4—4 of FIG. 2, in the locking position.

Lug mechanism 22 comprises a lug 76 slidably received in vertical passageway 44, a spring 78 located in lower section 48 of the vertical passageway, and a key cylinder 80 mounted in housing 18 for controlling movement of lug 76. Lug 76 has a radially outwardly extending flange 82 located adjacent its lower end. Flange 82 engages shoulder 50 to limit the inward or upward movement of lug 76 as illustrated in FIG. 4.

Lug 76 is movable within housing assembly 18 between a first position (illustrated in FIG. 4) in bolt recess 62 and engaging shoulder 52 to retain the bolt in its locking position, and a second position (illustrated in FIG. 5) disengaged from the bolt releasing the bolt for axial movement within the housing. When the lug is in its second position, the bolt is moved to its unlocked position under the biasing force provided by spring 74.

Lug 76 is biased towards its first position by a spring 78 which engages flange 82 and outer housing 24. The lug is moved to its second position disengaged from locking bolt 20 by operation of key cylinder 80. Key cylinder 80 has a rotatable cam 84 which is rotated upon insertion and rotation of key 86 in key slot 88. Cam 84 is eccentrically mounted on cylinder 80 such that the surface thereof will force lug 76 downwardly against the bias of spring 78 from the position illustrated in FIG. 4 to the position illustrated in FIG. 5.

Once lug 76 has been released from shoulder 52 and locking bolt 20 has moved to its unlocked position under the bias of spring 74, the key can be returned to its locked position and withdrawn from key cylinder 80. In this position, lug 76 will return to its first position with flange 82 abutting shoulder 50 such that the inward end of lug 76 is spaced just outwardly of spring 74 and the outer surface of locking bolt 20. When the locking bolt is pushed inwardly, lug 76 will ride on cam surface 58 and be pushed radially outwardly or downwardly against the bias of spring 78 to its second position enabling shoulder 52 to pass by the lug and permitting lug 76 to engage shoulder 52 and be received in recess 62 to retain locking bolt 20 in its locking position. Thus, locking bolt 20 can be locked merely by pushing in locking bolt 20 without the use of a key.

Key cylinder 80 is mounted within housing assembly 18. Access to key slot 88 is provided by key opening 90 in front face 32 of outer housing 24. The key opening has a transverse diameter less than the cross-sectional dimensions of key cylinder 80 to prevent removal of the key cylinder from the housing.

Figure 3:
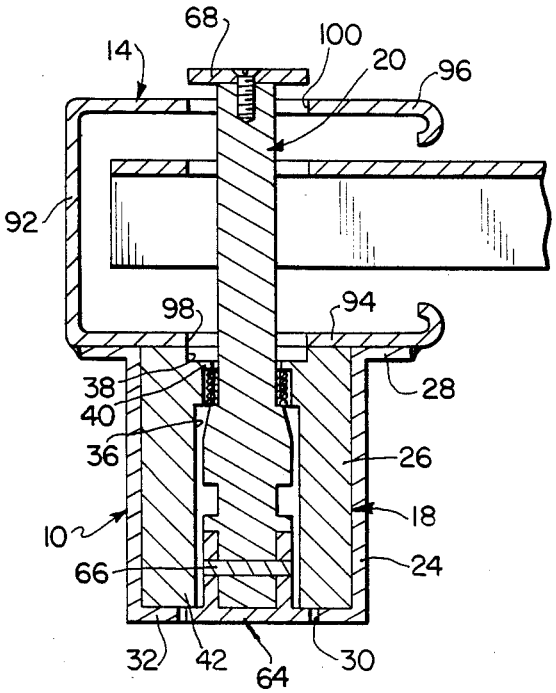
FIG. 3 is a top plan view of the gate locking system of FIG. 1 taken along lines 3—3 of FIG. 2, in the locking position.

As illustrated in FIG. 3, each guide track 14 is generally U-shaped in transverse cross section comprising a base member 92 and legs 94 and 96. Legs 94 and 96 are provided with axially aligned holes 98 and 100, respectively. Holes 98 and 100 are coaxially aligned with and of generally equal transverse cross-sectional dimensions with recess 38 in housing assembly 18 and with flange 68. Gate 12 has an aperture 102 which is axially aligned with track holes 98 and 100 when gate 12 is located in its closed position.

Locking assembly 10 is mounted on track 14 over holes 98 and 100 such that locking bolt 20 is coaxially aligned therewith. Key 86 is inserted within key slot 88 of key cylinder 80 and rotated, if necessary, to permit lug 76 to move to the position in which flange 82 engages shoulder 50, as illustrated in FIG. 4, while locking bolt 20 remains in the unlocked position. Locking bolt 20 is then pushed through hole 98, aperture 102 and hole 100.

As locking bolt 20 is moved towards its locking position, lug 76 is forced towards its second position (illustrated in FIG. 5) as its inward end engages camming surface 58. Lug 76 retains locking bolt 20 in the locked position as illustrated in FIG. 4 by abutting the outer end of shoulder 52 and being received in recess 62.

Figure 2:
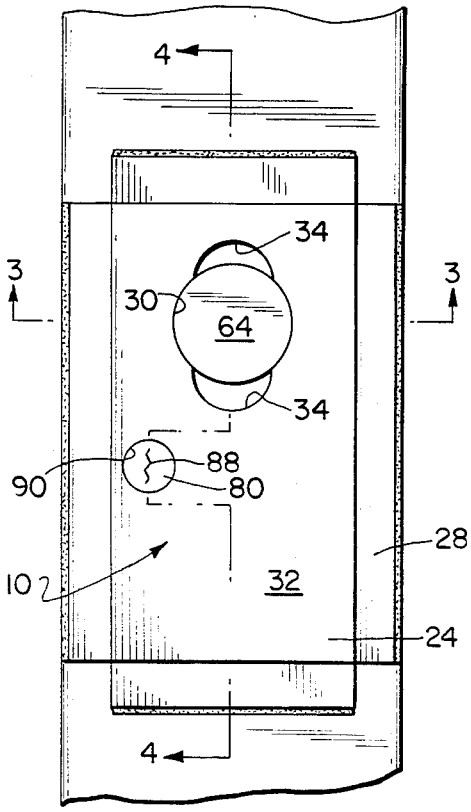
FIG. 2 is a front elevational view of the gate locking assembly according to the present invention.

In the locked position of the bolt illustrated in FIGS. 2–4, the outer end of head 64 of locking bolt 20 lies flush with front face 32 of housing assembly 18. In this manner, it is very difficult to grip the bolt with a burglary tool with enough force to pull it from the housing. Moreover, if a relatively high force is applied to head 64, it will separate from the remainder of bolt 20 upon the severing of shear pin 66.

Flange 68 provides a back-up locking mechanism in combination with hole 100. It will prevent unauthorized entry by bending the track around the end of the locking bolt. The flange will engage the track adjacent hole 100 preventing removal of the locking bolt from the hole as the track hole is moved out of alignment. Since the flange 68 is removably coupled to the bolt, it can be removed easily therefrom when the locking bolt is in its unlocked position to permit removal or replacement of the bolt and/or spring 74.

The camming surfaces and the arrangement of lug mechanism 22 permit the bolt to be moved from its unlocked position to its locked position by merely pushing and rotating locking bolt 22, without the use of a key. Thus, the locking operation can be performed extremely quickly, limiting the user's exposure during the vulnerable closing operation.

Housing assembly 18 is made of solid block construction and is welded to the track. This provides an extremely strong construction capable of withstanding attack by high impact tools such as sledge hammers.

The relatively small key receiving opening 90 prevents a burglar from tapping a hole in key cylinder 80 and pulling it out of the housing. The engagement of the cylinder with the outer housing adjacent opening 90 prevents such removal. With the key opening located in the side or vertical surface of the housing, it is exposed to facilitate operation of the locking assembly, while preventing it from being damaged or clogged by environmental conditions, such as rain, snow, etc.

Figure 6:
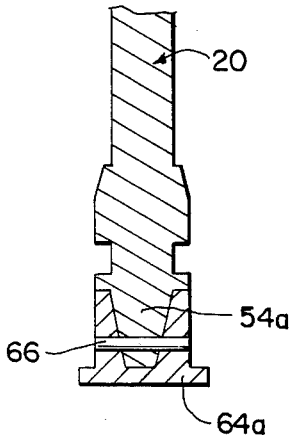
FIG. 6 is a partial, side elevational view in section of a locking bolt according to a second embodiment of the present invention.

An alternative arrangement for the connection between the head and the remainder of the locking bolt 20 is illustrated in FIG. 6. In this embodiment, the cavity in head **64*a* and bolt outer end 54*a* taper towards the outer ends thereof. The end and head are releasably coupled by a shear pin 66. The frustoconical shape of end 54*a*, provided by this modified arrangement, makes it more difficult to grip end 54*a* with a tool upon removal of head 64*a***.

Although the invention has been illustrated with particular reference to a sliding gate assembly for a store front or the like, it can also be used in a wide variety of closures, particularly roll-up gate systems for the back of a truck. Lock assemblies for a truck can be suitably coupled to the rear of the truck by a hidden bolt arrangement. The lock assembly and gate locking system of the present invention would provide the same advantages for a truck as provided for a store.

While various embodiments have been chosen to illustrate the invention, it will be understood by those skilled in the art that various changes and modifications can be made therein without departing from the scope of the invention as defined in the appended claims.

What is claimed is:

1. A lock assembly for a roll-up door which slides in two, oppositely directed tracks, comprising;

a housing having means for securing said housing to one of the tracks;

a locking bolt slidably mounted in said housing for axial movement between locking and unlocked positions, said bolt having a radially projecting shoulder or on outer surface thereof between inner and outer ends of said bolt and a flange extending radially from said inner end, said flange being removably coupled to said bolt;

spring means, engaging said housing and said bolt, for biasing said bolt toward said unlocked position; and lug means movably mounted in said housing between a first position engaging said bolt shoulder for retaining said bolt in said locking position, and a second position disengaged from said bolt shoulder for releasing said bolt for axial movement in said housing.

2. A lock assembly for a roll-up door which slides in two, oppositely directed tracks, comprising:

a housing having means for securing said housing to one of the tracks;

a locking bolt slidably mounted in said housing for axial movement between locking and unlocked positions, said bolt having a radially projecting shoulder on an outer surface thereof between inner and outer ends of said bolt and a head portion and a body portion which are releasably coupled, said head and body portions being releasably coupled by a shear pin;

spring means, engaging said housing and said bolt, for biasing said bolt toward said unlocked position; and lug means movably mounted in said housing between a first position engaging said bolt shoulder for retaining said bolt in said locking position, and a second position disengaged from said bolt shoulder for releasing said bolt for axial movement in said housing.

3. A lock assembly according to claim 2 wherein said head member has a cavity receiving one end of said body member.

4. A lock assembly according to claim 3 wherein said cavity and body member end received therein are frustoconical tapering toward said outer end.

5. A lock assembly for a roll-up door which slides in two, oppositely directed tracks, comprising:

a housing having means for securing said housing to one of the tracks;

a locking bolt slidably mounted in said housing for axial movement between locking and unlocked positions, said bolt having a radially projecting shoulder on an outer surface thereof between inner and outer ends of said bolt and a camming surface extending from said shoulder and tapering toward said inner end and in the direction of a locking bolt movement from said unlocked position to said locking position, said shoulder defining one side of a recess in said locking bolt, said locking bolt having a width at said recess substantially equal to a width of said locking bolt between said camming surface and said inner end;

spring means, engaging said housing and said bolt, for biasing said bolt toward said unlocked position; and lug means spaced outwardly of and adjacent said spring means when said bolt is in said unlocked position and movably mounted in said housing between a first position engaging said bolt shoulder and received in said recess for retaining said bolt in said locking position, and a second position disengaged from said bolt shoulder for releasing said bolt for axial movement of said housing;

whereby said camming surface forces said lug means to said second position permitting movement of said bolt to said locking position.

6. A lock assembly according to claim 5 wherein said shoulder is annular and said camming surface is frustoconical.

7. A lock assembly according to claim 5 wherein said bolt comprises a flange extending radially from said inner end.

8. A lock assembly according to claim 5 wherein said lug means is spring biased toward said first position.

9. A lock assembly according to claim 5 wherein movement of said lug means is controlled by a key actuated cylinder.

10. A lock assembly according to claim 9 wherein said key actuated cylinder has a key receiving opening in one end face thereof and is located in said housing; and said housing has an aperture, aligned with said key receiving opening, for passing the key into said key receiving opening, said housing aperture having transverse dimensions less than that of said key cylinder to prevent removal thereof.

11. A lock assembly according to claim 5 wherein said bolt has a head member and body member which are releasably coupled.

12. A gate lockiing system, comprising:

opposed channeled guide tracks, at least one of said tracks having a hole therethrough;

a gate movable within said tracks between open and closed positions, said gate having at least one aperture therethrough aligned with said track hole when said gate is in said closed position; and a lock assembly mounted on said one track over said hole, said lock assembly including a housing fixedly secured to said one track, a locking bolt slidably mounted in said housing for axial movement between a locking position in which an inner end of said locking bolt extends through said track hole and gate aperture and an unlocked position removed from said track hole and gate aperture, said bolt having a radially projecting shoulder or an outer surface thereof between inner and outer ends of said bolt, said bolt having a flange extending radially from said inner end, whereby said bolt inner end can pass through said track hole, but will engage said track upon attempting to withdraw said bolt by bending said track, said flange and said track hole having substantially equal transverse dimensions, spring means, engaging said housing and said bolt, for biasing said bolt toward said unlocked position, and lug means movably mounted in said housing between a first position engaging said bolt shoulder for retaining said bolt in said locking position, and a second position disengaged from said bolt shoulder for releasing said bolt for axial movement in said housing.

13. A gate locking system according to claim 12 wherein said bolt has camming surfaces extending from said shoulder and tapering toward said inner end, whereby said camming surface forces said lug means to said second position permitting movement of said bolt to said locking position.

14. A gate locking system according to claim 12 wherein said flange is removably coupled to said bolt.

15. A gate locking system according to claim 12 wherein said lug means is spring biased toward said first position.

16. A gate locking system according to claim 12 wherein movement of said lug means is controlled by a key actuated cylinder.

17. A gate locking system according to claim 16 wherein said key actuated cylinder has a key receiving opening in one end face thereof and is located in said housing; and said housing has an aperture, aligned with said key receiving opening, for passing the key into said key receiving opening, said housing aperture having transverse dimensions less than that of said key cylinder to prevent removal thereof.

18. A gate locking system according to claim 17 wherein said housing aperture is located in a housing face opposite said one track.

19. A gate locking system according to claim 12 wherein said bolt has a head member and body member which are releasably coupled.

20. A gate locking system according to claim 19 wherein said head and body portions are releasably coupled by a shear pin.

21. A gate locking system according to claim 20 wherein said head member has a cavity receiving one end of said body member.

22. A gate locking system according to claim 21 wherein said cavity and body member end received therein are frustoconical tapering toward said outer end.

23. A gate locking system according to claim 12 wherein said housing is welded to said one track.

24. A gate locking system according to claim 12 wherein said locking bolt outer end lies substantially flush with an outer surface of said housing in said locking position.

25. A gate locking system according to claim 24 wherein said housing has a passageway receiving said bolt, said passageway being elongated at an outer end thereof to facilitate manually gripping said bolt.

* * * * *